United States Patent [19]

Metzger

[11] 4,436,329

[45] Mar. 13, 1984

[54] LOCKING MECHANISM

[76] Inventor: Thomas J. Metzger, 6501 NW. 87th Ave., Parkland, Fla. 33067

[21] Appl. No.: 351,339

[22] Filed: Feb. 23, 1982

[51] Int. Cl.[3] ..... E05C 1/06

[52] U.S. Cl. ..... 292/150; 292/DIG. 46

[58] Field of Search ..... 292/150, 162, 179, 175, 292/DIG. 46

[56] References Cited

U.S. PATENT DOCUMENTS

| | | | |
|---|---|---|---|
| 89,191 | 4/1869 | Arnold et al. | 292/150 |
| 310,787 | 1/1885 | Buckley et al. | 292/150 |
| 3,756,639 | 9/1973 | Wilkinson | 292/150 X |

FOREIGN PATENT DOCUMENTS

| | | |
|---|---|---|
| 846983 | 9/1960 | United Kingdom . |
| 1396876 | 6/1975 | United Kingdom . |

*Primary Examiner*—Richard E. Moore

[57] ABSTRACT

Herein is disclosed a novel locking mechanism for a sliding window or door of the type having an outer surrounding rectangular frame mounted to a wall, and an inner transparent pane mounted to a second rectangular frame slidably mounted within the outer frame. The locking mechanism is incorporated within one side of the inner frame and comprises a slide, a latch adapted to move and lock the slide, a deadbolt attached to the slide and adapted to extend into the outer frame to lock the two frames together, and a latch accessed through a latch port defined in the side of the inner frame. The latch port comprises a wider locking segment and a narrower adjacent unlocking segment, and the latch comprises a post attached to the slide and a button slidably mounted on the post and sized to extend through the wider locking segment of the latch port. A coil spring surrounding the post forces the button into the wider locking segment when the deadbolt is in the lock position, thus maintaining the latch and slide in a vibration-resistant configuration until the button is depressed through the wider locking segment and transported along the unlocking segment of the port.

4 Claims, 4 Drawing Figures

LOCKING MECHANISM

BACKGROUND OF THE INVENTION

The present invention relates to a locking mechanism and, more specifically, to a vibration-resistant lock for sliding doors or windows.

In recent years the popularity of sliding doors and windows as an architectural element for residential housing has grown rapidly. A typical sliding door is mounted in a six to ten foot wide wall space extending from floor level to door height. A outer rectangular frame is attached to surround the space, and defines tracks or other means on the upper and lower edges thereof to permit sliding of one or more inner frames resting within the outer frame.

Generally, two inner frames are mounted within the outer frame. Each frame may contain at least a single pane of glass, and at least one of the frames is permitted to slide horizontally so as to open or close the space. Each sliding frame is typically provided with some form of locking mechanism intended to secure the inner frame in a fully closed position to prevent unauthorized entry to the premises. The locking mechanism is ordinarily incorporated within a vertical portion of the sliding inner frame which rests adjacent a vertical portion of the outer frame when the door is fully closed.

A standard prior art locking mechanism comprises a latch accessed from the indoor side of the inner frame, a latch port definded in the inner frame facing the outer frame, and a locking pin attached to the latch to engage a hook attached to the outer frame and extending through the port into the locking mechanism when the door is fully closed. The pin and latch have a simple vertical motion which normally involves a very small distance between the locked and unlocked positions. Moreover, the locking mechanism includes very little friction or inertia, so that modest vibrations applied to the inner frame from any side of the door will move the latch and pin from the locked state to the unlocked state. This characteristic of the standard prior art locking mechanism has lead to a steady increase in burglary, trespassing, and other unauthorized entries in homes utilizing sliding doors or windows.

Thus, it can be seen that there is a need for a locking mechanism for sliding doors or windows which incorporates a vibration-resistant positive locking feature, and which is easy to use from inside a dwelling.

SUMMARY OF THE INVENTION

The present inventive apparatus comprises a vibration-resistant locking mechanism mounted within a vertical side of a sliding frame of a sliding door or window. When the latch in the locking mechanism is placed in the locked position, a deadbolt is extended from an end of the vertical portion of the inner frame through a deadbolt bore in a horizontal portion of the surrounding outer frame. A slide is attached to the deadbolt and extends within the inner frame to a latch mechanism which may be placed, for instance, at waist height. A latching mechanism includes a latch port defined by the frame, a post extending from a slide to the port, a button slidably mounted on the post, and a coil spring surrounding the post between the button and the slide to force the button through a wider portion of the port when the slide is in the locked position. The button is surrounded by a recessed wider edge which prevents the button from completely passing through the port when the mechanism is locked. The button may be depressed and then moved inside the frame in order to move the post and slide to an unlocked position. A narrower portion of the port gives access to the button when the slide is once again to be moved and locked. Because the button rests in the wider portion of the port when the mechanism is locked, it resists vibrations which have been applied to prior art locking mechanisms from outside the door to unlock the door.

These and other objects and advantages of the present invention may be more clearly understood by referring to the following detailed description thereof, when read in conjunction with the accompanying drawings.

DETAILED DESCRIPTION OF THE DRAWINGS

Figure 1:
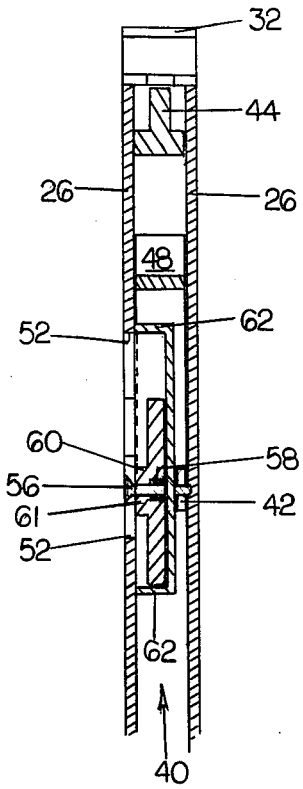
FIG. 1 is a cutaway side view of a sliding inner frame incorporating the present inventive apparatus in an unlocked position.
Figure 2:
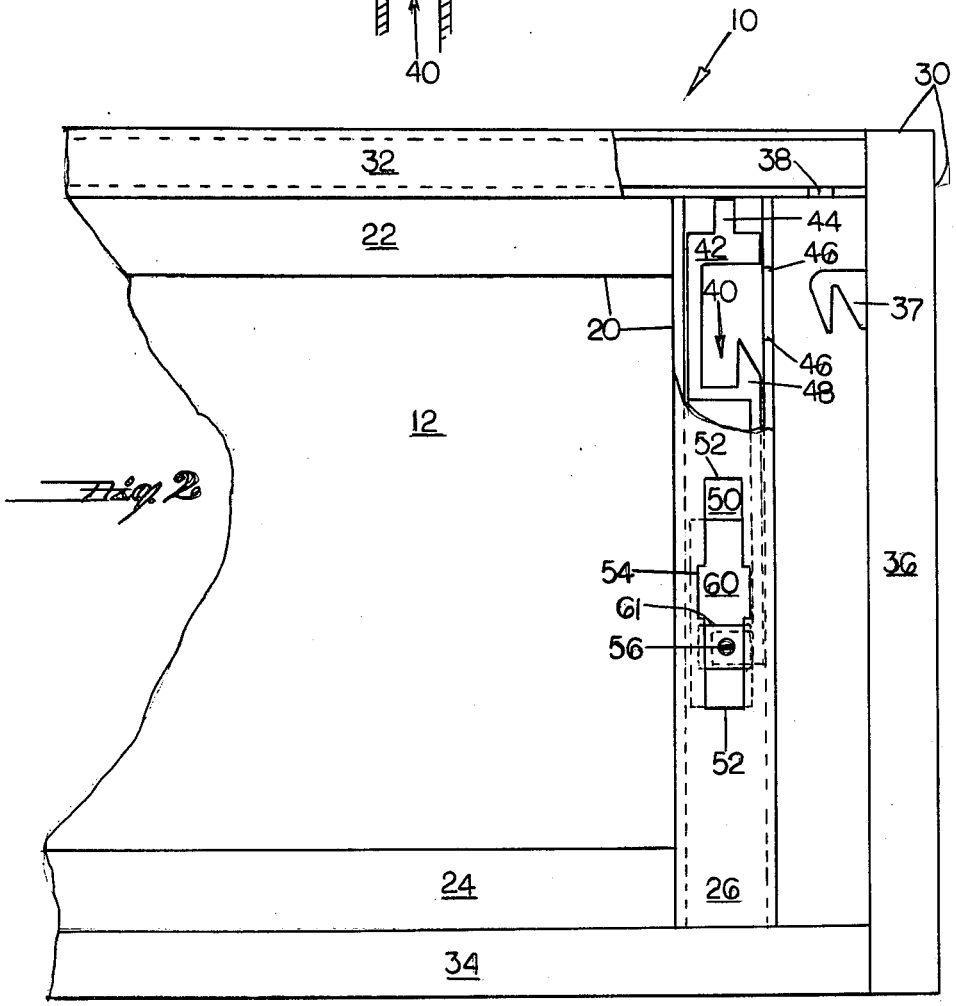
FIG. 2 is a partially cutaway front view of the apparatus of FIG. 1 also in an unlocked position.
Figure 3:
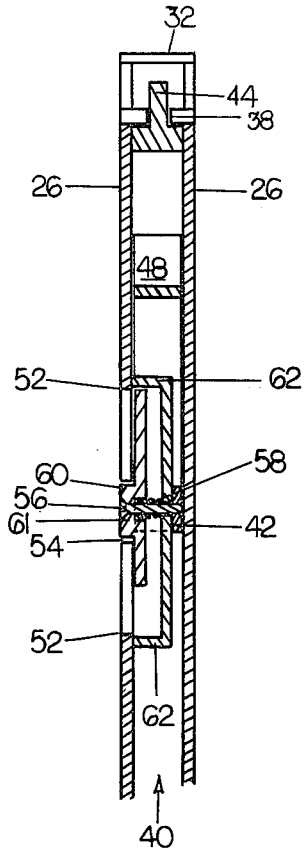
FIG. 3 is a cutaway side view of the apparatus of FIG. 1 in a locked position.
Figure 4:
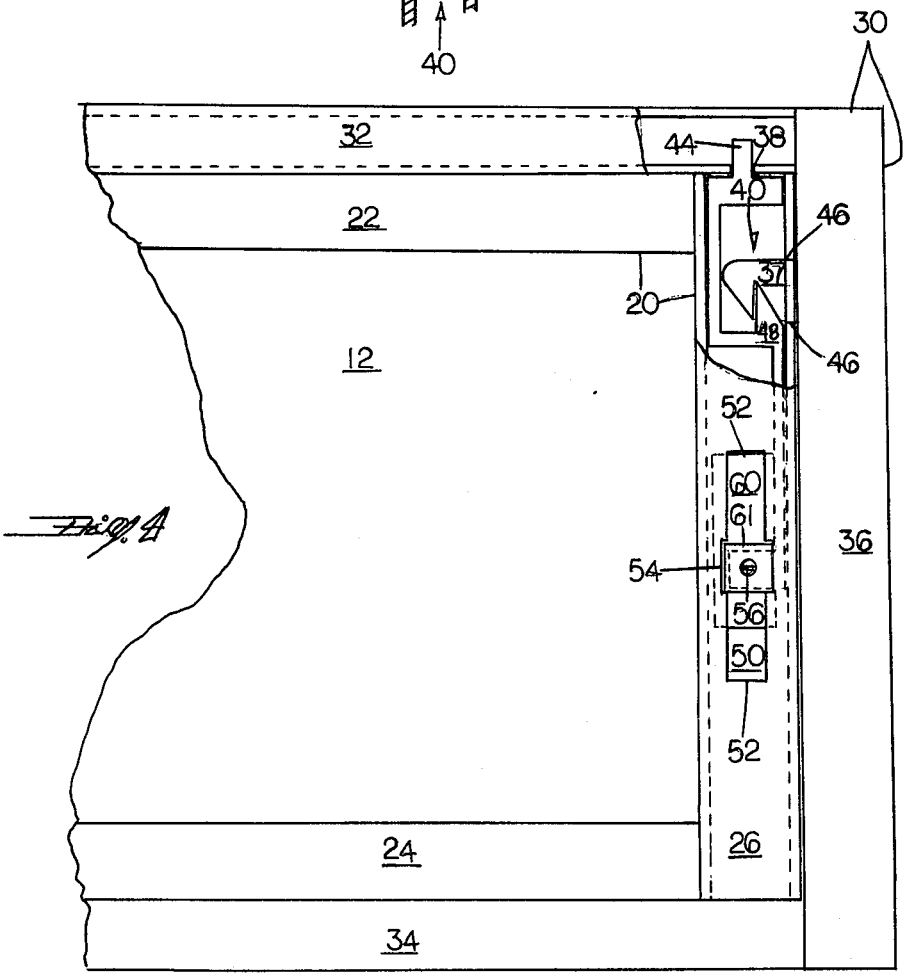
FIG. 4 is a partially cutaway front view of the apparatus of FIG. 1, also in a locked position.

The best mode and preferred embodiment of the present inventive apparatus is illustrated in FIGS. 1 through 4. Referring to FIGS. 2 and 4, a pane of glass 12 is mounted in a frame 20 comprising a horizontal top portion 22, a horizontal bottom portion 24, a vertical side portion 26, and an opposite side portion (not shown). Surrounding frame 20 is an outer frame 30, typically fixed to a standing structure such as a wall. Frame 30 comprises a top horizontal portion 32, bottom horizontal portion 34, vertical side portion 36, and an opposite side portion (not shown). Frame 30 supports and constrains frame 20 within frame 30, so that portion 22 slides along the length of portion 32 and portion 24 slides along the length of portion 34. When the window or door is closed as is illustrated in FIG. 4, side portion 26 abuts side portion 36. The length of portions 22 and 24 are typically much less than that of portions 32 and 34 so that frame 20 may slide to create a substantial opening between portions 26 and 36. Any conventional well-known adaptation to provide slideable support may be incorporated in portions 22, 24, 32, and 34.

Again referring to all of the Figures, a novel secure locking system 40 is incorporated within portion 26 of frame 20 to provide positive locking to hook 37 extending from frame 36 and deadbolt bore 38 defined in portion 32. The locking mechanism 40 comprises a slide 42 adapted to slide vertically within portion 26, a deadbolt 44 defined atop slide 42, a locking pin 48 extending vertically from slide 42 beneath deadbolt 44, and a latch 50 to operate the slide 42 when portion 26 is abutted against portion 36.

Turning now to FIGS. 3 and 4, the locking mechanism 40 is illustrated in a locked position. Deadbolt 44 extends through deadbolt bore 38 defined in the lower surface of portion 32 adjacent portion 36. Hook 37 is secured to portion 36 and extends into portion 26 through hook port 46 defined aside portion 26. Locking pin 48, a part of slide 42, extends to engage hook 37 and, together with deadbolt 44 and deadbolt bore 38, prevent sliding motion of frame 20 within frame 30.

Latch port 52 is defined in the side of portion 26 to give access to latch mechanism 50. A latch post 56 is fixedly attached to slide 42 and extends through portion 26 to latch port 52. A latch button 60 is movably mounted on post 56, and surrounding post 56 between button 60 and slide 42 is spring 58. Spring 58 is compressed to exert force on button 60 and slide 42 so that these components will be spaced apart. A central segment 54 of latch port 52 is widened to allow a raised portion 61 of button 60 to extend through port 52 under impetus of spring 58. The widened segment 54 is placed so that raised portion 61 may extend therein only when the apparatus is locked. The narrower majority of latch port 52 surrounding the segment 54 prevents downward motion of button 60 and slide 42 which would otherwise unlock the apparatus. The force of spring 58 maintains the raised portion 61 within segment 54 unless the user of the window or door depresses button 60 behind the level of port 52 and then moves button 60 downward along port 52, thereby removing locking pin 48 from hook 37 and deadbolt 44 from bore 38. A lower portion 63 of button 60 surrounds raised portion 61 and prevents ejection of the button 60 through port 52.

Turning now to FIGS. 1 and 2, the present inventive apparatus is illustrated in the unlocked position. The button 60 is depressed below the level of port 52, and slide 42 has been lowered accordingly. A portion of port 52 below wide area 54 allows the user to reach button 60 for the purpose of raising slide 42 and relocking button 60 to lock the door or window once again. A latch casing 62 within portion 26 prevents downward motion of button 60 and slide 40 to below the level of port 52, so that the user may always reach button 60. In the unlocked position, the user may slide frame 20 along frame 30 so that portion 26 separates from portion 36.

Thus, it can be seen that the present inventive apparatus provides a distinct improvement over the prior art. The locking mechanism combines ease of use with a positive prevention of latch release caused by frame vibrations. Therefore, it will be appreciated that a major burglary technique enabled by a deficiency in the prior art has been eliminated by the present invention. The invention also minimizes the number of moving parts and the number of steps required to assemble those parts, thus reducing costs and frequency of misassembly. One obvious modification of the present invention would be to place the slide mechanism in a downward orientation so that gravity rather than pressure by the user will draw the slide into a locked position when portion 26 abuts portion 36. Another obvious modification would be to provide for simultaneous upward and downward slides with corresponding twin hooks, locking pins and deadbolts.

In the foregoing description, the invention has been described with reference to a particular preferred embodiment, although it is to be understood that the specific details shown are merely illustrative and the invention may be carried out in other ways without departing from the true spirit and scope of the following claims.

What is claimed:

1. A locking mechanism for a sliding window or door of the type having an inner transparent pane mounted to a rectangular inner frame and an outer surrounding rectangular frame mounted to a wall, said locking mechanism being incorporated within one side of said inner frame and comprising a slide, a latch adapted to move and lock said slide, a deadbolt attached to said slide and adapted to extend into said outer frame to lock said frames together, said inner frame defining a latch port adjacent said latch, said latch port comprising a wider locking segment and a narrower adjacent unlocking segment, said latch comprising a latch post, a latch button, a latch casing, and a latch spring, said latch post being coupled to said slide and extending therefrom to said latch port, said latch button being slideably mounted on said latch post and defining a raised button portion and a lower button portion, and latch spring surrounding said latch post between said latch button and said slide, so that said raised button portion will extend through said locking segment when said latch button is manipulated to move said slide to engage said deadbolt with said outer frame, said latch spring maintaining said raised button portion in said locking segment until said latch button is depressed, said latch casing being positioned between said slide and said latch port, said casing surrounding said latch button and defining slot means for passage of said latch bolt between said latch button and said slide, said latch casing being adapted to prevent excursion of said latch button and said slide beyond said latch port within said inner frame.

2. The apparatus of claim 1 wherein said outer frame additionally includes a hook extending inward from said outer frame to engage said locking mechanism when said window or door is closed, and wherein said slide additionally comprises a pin adapted to engage said hook when said deadbolt engages said outer frame.

3. The apparatus of claim 2 wherein said lower button portion is larger than said raised button portion, to prevent said latch button from exiting said inner frame through said latch port.

4. The apparatus of claim 2 wherein said inner frame defines a hook port positioned to admit said hook within said inner frame adjacent said locking pin.

* * * * *